United States Patent [19]

Fink et al.

[11] Patent Number: 4,476,182

[45] Date of Patent: Oct. 9, 1984

[54] METHOD FOR STRENGTHENING FIBROUS ARTICLES

[75] Inventors: Herbert Fink, Bickenbach; Heiner Kniese, Seeheim-Jugenheim; Norbert Suetterlin, Ober-Ramstadt; Klaus Mueller, Gross-Bieberau; Willi Tilch, Reinheim; Werner Siol, Darmstadt, all of Fed. Rep. of Germany

[73] Assignee: Röhm GmbH, Darmstadt, Fed. Rep. of Germany

[21] Appl. No.: 455,661

[22] Filed: Jan. 5, 1983

[30] Foreign Application Priority Data

Jan. 23, 1982 [DE] Fed. Rep. of Germany ..... 3202122

[51] Int. Cl.[3] ..... B32B 27/08; B05D 3/02

[52] U.S. Cl. ..... 428/265; 427/389; 427/389.9; 427/392; 428/236; 428/264; 428/267; 428/288; 428/290

[58] Field of Search ..... 427/385.5, 393.5; 428/236, 264, 265, 267, 288, 289, 290, 262

[56] References Cited

U.S. PATENT DOCUMENTS 4,268,549 5/1981 Fink et al. ..... 427/385.5
4,293,600 10/1981 Fink et al. ..... 427/385.5

FOREIGN PATENT DOCUMENTS 12032 6/1980 European Pat. Off. .
12033 6/1980 European Pat. Off. .

*Primary Examiner*—Thurman K. Page
*Attorney, Agent, or Firm*—Curtis, Morris & Safford

[57] ABSTRACT

What are disclosed are a method for the reinforcement of a fibrous article with an aqueous dispersion of a resin, free of formaldehyde and acrylonitrile, comprising at least 40 weight percent of alkyl acrylates and/or methacrylates having at least 4 carbon atoms in the alkyl group; up to 57 weight percent of alkyl acrylates or methacrylates having not more than 3 carbon atoms in the alkyl group, or of styrene; less than 1 weight percent of acrylic acid or of methacrylic acid; and from 3 to 15 weight percent of a hydroxyalkyl ester of an unsaturated carboxylic acid, as well as reinforced fibrous articles made by this method and distinguished by high wet strength and by low loss of the resin binder on washing with boiling water.

18 Claims, No Drawings

METHOD FOR STRENGTHENING FIBROUS ARTICLES

The present invention relates to the strengthening or reinforcement of fibrous articles by the application thereto of an aqueous dispersion of an acrylic resin which is free of formaldehyde, of formaldehyde-liberating substances, and of acrylonitrile. The invention further relates to such fibrous articles reinforced with said resin dispersions.

Heretofore, aqueous dispersions of acrylic resins containing self-crosslinking amide methylol groups and, possibly nitrile groups, have been used for the reinforcement of fibrous articles possessing wet strength, resistance to water and detergent solutions, and low water absorption. During the drying of the fibrous material so treated, small amounts of formaldehyde or acrylonitrile may be released, which has of late aroused concern for health reasons. It has therefore been sought to reinforce fibrous articles with acrylic resin dispersions which on being heated give off neither acrylonitrile nor formaldehyde, yet permit end-use properties to be obtained which are comparable to those of the dispersions used heretofore in the art. ;p Published European patent application Nos. 12,032 and 12,033 describe reinforced fibrous articles manufactured by the use of dispersions of acrylic resins free of formaldehyde and acrylonitrile. When the fibrous article is made predominantly of hydrophilic fibers, and in particular cellulosic fibers, a dispersion of an acrylic resin is used which is composed largely of $C_4$- to $C_8$-alkyl esters of acrylic acid or of methacrylic acid, but which also incorporates methyl methacrylate or styrene and from 0.5 to 10 percent of an unsaturated dicarboxylic acid, or of a mixture of such a dicarboxylic acid with an unsaturated monocarboxylic acid. The resin component may further include amides or hydroxyalkyl esters of acrylic acid or of methacrylic acid in amounts up to 10 weight percent. However, it is not claimed that these comonomers have an effect on the end-use properties of the resin dispersion. Dispersions of a very similar composition are proposed for the reinforcement of fibrous articles consisting predominantly of hydrophobic fibers. The carboxylic resin components of such dispersions may be formed solely of unsaturated monocarboxylic acids. The minimum content of unsaturated carboxylic acids is 1 weight percent; the preferred content is 2 to 4 weight percent. However, the launderability of fibrous articles finished with these dispersions is not satisfactory, which may be due to their acid-group content. Nevertheless, these groups are essential to securing satisfactory wet adhesion or wet strength in the absence of crosslinking comonomers such as N-methylolacrylamide.

The object of the present invention is to provide reinforced fibrous articles having reduced water absorption, good wet adhesion or wet strength, and low binder loss on washing with boiling water and on treatment with alkalis, by the application thereto of aqueous dispersion of an acrylic resin which is free of acrylonitrile and formaldehyde.

A feature of the invention is a method for reinforcing a fibrous article by applying thereto an aqueous dispersion of a synthetic resin comprising:

(a) at least 40 weight percent of at least one alkyl ester of acrylic acid or of methacrylic acid having at least 4 carbon atoms in the alkyl group; and (b) from 3 to 15 weight percent of at least one hydroxyalkyl ester of an alpha, beta-unsaturated carboxylic acid, and drying the treated article at a temperature above 110° C.

The aforementioned resin may also contain:

(c) up to 57 percent by weight of styrene or of at least one alkyl ester of acrylic acid or of methacrylic acid having not more than 3 carbon atoms in the alkyl group;

(d) acrylic acid or methacrylic acid in amounts of less than 1 weight percent; and (e) optional further monoethylenically unsaturated monomers different from those mentioned earlier and which are free of amide methylol groups or derivatives thereof and which are free of carboxy groups.

Fibrous articles made either of hydrophilic or of hydrophobic fibers, or of blends of such fibers, may be reinforced according to the invention. The reinforcement of fibrous articles made predominantly of hydrophobic fibers is preferred. The most important fibers of this type are polyester, polyamide, and polypropylene fibers of which polyester fibers are preferred. In addition to wool and silk, hydrophilic fibers include native or regenerated cellulosic fibers such as cotton and viscose rayon staple fiber. An interesting application of the invention is the reinforcement of mineral fiber articles.

The most important of the fibrous articles to be reinforced are nonwoven fabrics. The strength which they need is use is imparted to them through reinforcement in accordance with the invention. In the reinforcement of woven, warp-knit, and weft-knit fabrics, improvement of the slippage resistance or knot strength is the primary consideration.

The advantageous effects of the invention are illustrated by the values given in the Table which follows, which values pertain to reinforced polyester fiber nonwovens weighing 18 g/m$^2$ and having a binder loading of 14 to 16 percent.

| Composition of acylic resin (Wt. %) | Binder loss in washing with boiling water (Wt. %) | Breaking strength F in conformity with DIN 53857, Part 2 | | |
|---|---|---|---|---|
| | | Dry (Newtons) | Wet (Newtons) | Relative (%) |
| 75 n-butyl methacrylate<br>20 n-butyl acrylate<br>5 2-hydroxyethyl acrylate | 0 | 92 | 82 | 89.1 |
| 75 n-butyl methacrylate<br>19 n-butyle acrylate<br>1 methacrylic acid<br>5 2-hydroxyethyl acrylate | 0 | 94 | 74 | 78.7 |
| 52 n-butyl acrylate<br>42 methyl methacrylate<br>1 methacrylic acid | 0 | 99 | 83 | 83.8 |

-continued

| Composition of acylic resin (Wt. %) | Binder loss in washing with boiling water (Wt. %) | Breaking strength F in conformity with DIN 53857, Part 2 | | |
|---|---|---|---|---|
| | | Dry (Newtons) | Wet (Newtons) | Relative (%) |
| 2-hydroxyethyl acylate | | | | |
| Comparative dispersion (commercially available under the tradename "Primal E 1715"): | | | | |
| Butyl acrylate<br>Styrene<br>Itaconic acid<br>Methacrylic acid | 65 | 102 | 74 | 72.5 |

It must be regarded as surprising that, with a reduced amount of unsaturated carboxylic acid, it is possible to obtain high wet strength, low water absorption, and especially a substantial reduction in binder loss on washing with boiling water by incorporating hydroxyalkyl esters into an acrylic resin binder. The hydroxyalkyl esters of unsaturated carboxylic acids are markedly hydrophilic and usually form water soluble homopolymers. The same is true of the amides of acrylic acid or of methacrylic acid. As is to be expected, the latter markedly reduce the resistance of the reinforced fibrous articles to washing with boiling water when they are included in the composition of the acrylic resin. Surprisingly the hydroxyalkyl esters have the opposite effect. However, this is true only when the acrylic resin contains either no carboxyl groups or only very few of such groups.

Fibrous articles reinforced in accordance with the present invention are distinguished by a very low loss in strength in the wet state compared with their dry strength. The level of the dry strength values can be adjusted in the usual manner to meet specified requirements by controlling the film hardness. Preservation of that strength level also in the wet state is largely and satisfactorily achieved by the invention.

In order that they may be sufficiently resistant to washing even without crosslinking, the acrylic resins of the invention must be relatively hydrophobic. For this reason they contain, as a first component, at least 40 weight percent of units of alkyl esters of acrylic acid and/or of methacrylic acid having at least 4 carbon atoms in the alkyl group. Alkyl groups having from 4 to 8 carbon atoms are preferred. Particularly preferred are n-butyl esters. The amount of this hydrophobic ester component is preferably from 50 to 80 weight percent of the acrylic resin.

Depending on the end use of the reinforced fibrous article, the acrylic resin may range from soft and self-adhesive to hard and nontacky. These properties are determined in the usual manner through a proper quantitative ratio of hardening monomeric constituents to softening monomeric constituents. Since the higher alkyl esters of the aforementioned first component which impart hydrophobicity usually also have a softening action, the acryclic resins may include styrene and/or alkyl esters of acrylic acid and/or of methacrylic acid having not more than 3 carbon atoms in the alkyl group as a component imparting hardness. The hardness of the acrylic resin may also be increased by increasing the proportion of methacrylate esters in the first component at the expense of acrylate esters.

The end-use properties of the reinforced fibrous articles do not require that the acrylic resin contain carboxyl groups. However, for reasons of improved stability of the aqueous dispersion, it may be advantageous for the composition of the acrylic resin to include acrylic acid or methacrylic acid in an amount of not less than 0.1 weight percent as a further component. If the amount of acrylic acid or of methacrylic acid exceeds 1 percent, the resistance of the reinforced fibrous articles to washing with boiling water is greatly reduced. Hence, the proportion of these acids should be less than 1 weight percent, and preferably not over 0.5 weight percent.

Hydroxyalkyl esters of alpha, beta-unsaturated polymerizable mono- or di-carboxylic acids form an important further component of the emulsion polymer in an amount from 3 to 15 weight percent. These hydroxyalkyl esters are preferably derived from acrylic acid or from methacrylic acid, particularly from acrylic acid. As a rule they contain an hydroxyl group which is attached to an alkyl group having from 2 to 4 carbon atoms. Hydroxyethyl acrylate and methacrylate, 2-hydroxypropyl acrylate and methacrylate, and 4-hydroxybutyl acrylate and methacrylate are preferred. The acrylic resin preferably contains 4 weight percent or more of units of these hydroxyalkyl esters. Amounts over 10 weight percent generally produce no further benefits. Thus, this limit is preferably not exceeded.

The acrylic resin may optionally include further monoethylenically unsaturated comonomers which are different from those in the aforementioned components. Polyunsaturated monomers having a crosslinking effect should not be included. Such monomers, for example ethylene glycol dimethacrylate, are occasionally contained as impurities in the hydroxyalkyl esters to be used. In any event, the content of such polyunsaturated monomers should not exceed 0.1 weight percent of the acrylic resin.

Since no formaldehyde must be liberated during the drying of the fibrous articles finished with the acrylic resin dispersion of the invention, the resin should not include monomers which contain formaldehyde in masked, releasable form. These monomers include, in particular, N-methylolamides of unsaturated polymerizable carboxylic acids and derivatives thereof which may be converted by hydrolysis to such N-methylolamides, for example the corresponding N-methylol alkyl ethers or Mannich bases. Nor should the dispersions contain any formaldehyde condensation resins. Preferably, acrylonitrile and methacrylonitrile, too, are not included in the acrylic resin since residues of these monomers might remain in the aqueous phase and be released as the finished fibrous article is being dried.

The acrylic resin dispersions may be prepared by any of the usual emulsion polymerization methods. They may contain anionic, cationic, or nonionic emulsifying agents or compatible mixtures thereof. They are preferably prepared with solid contents ranging from 50 to 70 weight percent.

The preparation of a dispersion for the reinforcement of fibrous articles depends on the method by which the dispersion is to be applied and on the requirements to be met by the end product. The additives customarily used in these methods, such as wetting agents, antifoaming agents, heat sensitizing agents, softeners and lubricating agents, antistatic agents, antimicrobial agents, colorants, fillers, flame retardants, odorants, etc., may be used here, too. The dispersions are generally diluted with water to a binder content ranging from 10 to 40 weight percent. The viscosity of the diluted dispersion may range from 10 to 10000 mPa/sec. For the reinforcement of wadding made of polyester, polyamide, or polyacrylonitrile fibers, for example, a liquor having a solids concentration of about 15 to 25 percent is sprayed onto them. Compact nonwovens and needle-loom felts can readily be reinforced by impregnation with 10 to 40 percent liquors, followed by squeezing and drying. Light nonwovens may also be reinforced by foam impregnation. To this end, foaming agents and foam stabilizers are added to an about 10 to 25 percent dispersion, which is then foamed with air to a weight from 100 to 300 grams/liter. Impregnation is best carried out on a horizontal mangle. Very light nonwovens may be partially reinforced by being imprinted with pastes which contain from 20 to 40 percent of binder and are formulated to have a viscosity ranging from 4000 to 8000 mPa.sec. Needle-loom felts for high grade floor and wall coverings are preferably padded with somewhat thickened and optionally foamed liquors. Nonwovens can also be reinforced by spread coating.

The reinforced fibrous articles generally contain from 5 to 100 percent of binder, based on the weight of the fibers. The preferred binder content ranges from 10 to 30 weight percent. The fibrous articles finished in accordance with the invention acquire their good end-use properties only upon being dried at dryer temperatures from above 110° C. to about 200° C., and preferably in the 120° to 160° C. range.

When the reinforced fibrous article is further required to be resistant to organic solvents, a crosslinking agent such as glyoxal may be added to the dispersion.

A better understanding of the present invention and of its many advantages will be had by referring to the following Examples, given by way of illustration.

EXAMPLES 1–12

(A) Preparation of Resin Dispersions

In a 1-liter round-bottomed flask equipped with a stirrer and contact thermometer, 155 parts of fully desalinated water were heated with stirring to 80° C. and mixed with 0.16 part of a 90% sulfonated, ethoxylated alkylarylol-maleic acid, dissolved in 5 parts of a monomer, namely butyl methacrylate in Examples 1, 2, and 4–8,
butyl acrylate in Examples 3 and 12, and
ethyl acrylate in Examples 9–11, and with 5 parts of a 4% ammonium persulfate solution. After a 4-minute interval, an emulsion of 240 parts fully desalinated water,
1 part of the above emulsifier,
0.9 part ammonium persulfate, and
395 parts of a monomer mixture in accordance with the Table which follows was added dropwise over a period of 4 hours at 80° C.

The temperature was then held at 80° C. for another 2 hours. The charge was then cooled to room temperature and the pH value adjusted to 2.2. with phosphoric acid. Stable, coagulate-free dispersions were so obtained.

(B) Reinforcement of Fibrous Articles and Application Testing

A woven polyester fabric freed of any coatings such as sizes and finishing materials was impregnated with an about 50 percent resin dispersion. Excess dispersion was squeezed off by means of a mangle to a liquor absorption from 80 to 100 percent. The fabric strip was dried for 5 minutes in a circulating air drying cabinet at 80° C. and, after cooling, the resin loading was determined. The specimen, measuring 18×18 cm, was then washed in a "Linitest" laboratory washing machine for 10 minutes at 40° C. with 125 ml of a solution containing 3 g of Castile soap and 2 g of calcined soda per liter. The specimen was then rinsed, first with hot water and then with cold water, following which it was dried for 30 minutes at 90° C. After cooling, the resin loading was determined once more. The loss of binder in washing with boiling water ("Binder Loss") is given in the Table in section (C) in percent of the resin loading.

For determination of the breaking strength, a thermally pre-reinforced polyester nonwoven of a weight of about 18 g/m$^2$ was impregnated with a resin dispersion diluted to an about 25 percent solids content. Excess dispersion was squeezed off with a mangle to leave a resin loading of about 15 percent. The moist nonwoven was then dried for 5 minutes at 140° C. in a tenter frame. The breaking strength was determined using a tensile testing machine conforming to DIN No. 51221 in conformity with DIN No. 53857, Part 2 on the dry nonwoven (F) and on the wet nonwoven ($F_w$) after 1 hour's in immersion in water. The results are presented in section (C) of the Table.

(C) Tabulation of Polymer Compositions and Results of Application Testing

Examples 1 to 8 illustrate the invention. Examples 9 to 12 are comparative tests with dispersions not failing within the scope of the invention.

| (All parts are parts by weight) | Binder Loss | Breaking Strength F | $F_w$ | $F_{rel}$ |
|---|---|---|---|---|
| Example 1 | | | | |
| 296 parts of butyl methacrylate<br>76 parts of butyl acrylate<br>20 parts of 2-hydroxyethyl acrylate<br>3 parts of methacrylic acid | 0 | 94 | 74 | 79 |
| Example 2 | | | | |

-continued

| (All parts are parts by weight) | Binder Loss | Breaking Strength F | $F_w$ | $F_{rel}$ |
|---|---|---|---|---|
| 146 parts of butyl methacrylate<br>142 parts of butyl acrylate<br>84 parts of methyl methacrylate<br>20 parts of 2-hydroxyethyl acrylate<br>3 parts of methacrylic acid | 0 | 93 | 77 | 83 |
| Example 3 | | | | |
| 204 parts of butyl acrylate<br>168 parts of methyl methacrylate<br>20 parts of 2-hydroxyethyl acrylate<br>3 parts of methacrylic acid | 0 | 99 | 83 | 84 |
| Example 4 | | | | |
| 296 parts of butyl methacrylate<br>76 parts of butyl acrylate<br>10 parts of 2-hydroxyethyl acrylate<br>10 parts of methacrylamide<br>3 parts of methacrylic acid | 0 | 92 | 75 | 82 |
| Example 5 | | | | |
| 276.8 parts of butyl methacrylate<br>75.2 parts of butyl acrylate<br>40 parts of 2-hydroxyethyl acrylate<br>3 parts of methacrylic acid | 0 | 84 | 75 | 90 |
| Example 6 | | | | |
| 295 parts of butyl methacrylate<br>80 parts of butyl acrylate<br>20 parts of 2-hydroxyethyl acrylate | 0 | 92 | 82 | 89 |
| Example 7 | | | | |
| 295 parts of butyl acrylate<br>80 parts of butyl acrylate<br>20 parts of 4-hydroxybutyl acrylate | 0 | 89 | 73 | 82 |
| Example 8 | | | | |
| 203 parts of butyl acrylate<br>170 parts of styrene<br>20 parts of 2-hydroxyethyl acrylate<br>2 parts of acrylic acid | 0 | 95 | 83 | 87 |
| Example 9 (Comparative Test) | | | | |
| 295 parts of butyl methacrylate<br>79.2 parts of butyl acrylate<br>20 parts of 4-hydroxybutyl acrylate<br>0.8 parts of allymethacrylate | 0 | 74 | 54 | 73 |
| Example 10 (Comparative Test) | | | | |
| 375 parts of ethyl acrylate<br>20 parts of 2-hydroxyethyl acrylate | 0.5 | 73 | 52 | 72 |
| Example 11 (Comparative Test) | | | | |
| 375 parts of ethyl acrylate<br>20 parts of 4-hydroxybutyl acrylate | 1 | 59 | 43 | 73 |
| Example 12 (Comparative Test) | | | | |
| 375 parts of ethyl acrylate<br>20 parts of 2-hydroxyethyl methacrylate | 1 | 69 | 50 | 72 |

What is claimed is:

1. A method for reinforcing a fibrous article by applying to said article an aqueous dispersion of an acrylic resin consisting essentially of:
   (a) at least 40 percent by weight of at least one member selected from the group consisting of alkyl acrylates and alkyl methacrylates having at least 4 carbon atoms in the alkyl; and
   (b) 3 to 15 percent by weight of an hydroxyalkyl ester of an alpha, beta-unsaturated polymerizable carboxylic acid; and then drying the treated article at a temperature over 110° C.

2. A method for reinforcing a fibrous article by applying to said article an aqueous dispersion of an acrylic resin consisting essentially of:
   (a) at least 40 percent by weight of at least one member selected from the group consisting of alkyl acrylates and alkyl methacrylates having at least 4 carbon atoms in the alkyl;
   (b) 3 to 15 percent by weight of an hydroxyalkyl ester of an alpha, beta-unsaturated polymerizable carboxylic acid; and
   (c) acrylic acid or methacrylic acid in an amount up to 1 percent by weight;
   and then drying the treated article at a temperature over 110° C.

3. A method for reinforcing a fibrous article by applying to said article an aqueous dispersion of an acrylic resin consisting essentially of:
   (a) at least 40 percent by weight of at least one member selected from the group consisting of alkyl acrylates and alkyl methacrylates having at least 4 carbon atoms in the alkyl;

(b) 3 to 15 percent by weight of an hydroxyalkyl ester of an alpha, beta-unsaturated polymerizable carboxylic acid; and (c) at least one additional monoethylenically unsaturated non-crosslinking monomer different from the other recited monomers, which additional monomer is free of amide methylol groups or derivatives thereof and is free of carboxyl groups.

4. A method for reinforcing a fibrous article by applying to said article an aqueous dispersion of an acrylic resin consisting essentially of:

(a) at least 40 percent by weight of at least one member selected from the group consisting of alkyl acrylates and alkyl methacrylates having at least 4 carbon atoms in the alkyl;

(b) 3 to 15 percent by weight of an hydroxyalkyl ester of an alpha, beta-unsaturated polymerizable carboxylic acid;

(c) acrylic acid or methacrylic acid in an amount up to 1 percent by weight; and (d) at least one additional monoethylenically unsaturated non-crosslinking monomer different from the other recited monomers, which additional monomer is free of amide methylol groups or derivatives thereof and is free of carboxyl groups;

and then drying the treated article at a temperature over 110° C.

5. A method as in claim 3 wherein component (c) includes up to 57 percent, by weight of said resin, of at least one member selected from the group consisting of styrene and alkyl acrylates and methacrylates having not more than 3 carbon atoms in the alkyl.

6. A method as in claim 4 wherein component (d) includes up to 57 percent, by weight of said resin, of at least one member selected from the group consisting of styrene and alkyl acrylates and methacrylates having not more than 3 carbon atoms in the alkyl.

7. A fibrous article made by the method of claim 1.

8. A fibrous article as in claim 7 which predominantly comprises polyester fibers.

9. A fibrous article as in claim 7 which is a nonwoven fabric.

10. A fibrous article made by the method of claim 2.

11. A fibrous article as in claim 10 which predominantly comprises polyester fibers.

12. A fibrous article as in claim 10 which is a nonwoven fabric.

13. A fibrous article made by the method of claim 3.

14. A fibrous article as in claim 13 which predominantly comprises polyester fibers.

15. A fibrous article as in claim 13 which is a nonwoven fabric.

16. A fibrous article made by the method of claim 4.

17. A fibrous article as in claim 16 which predominantly comprises polyester fibers.

18. A fibrous article as in claim 16 which is a nonwoven fabric.

* * * * *